US005307581A

United States Patent [19]

Kalmykow

[11] Patent Number: 5,307,581

[45] Date of Patent: May 3, 1994

[54] INFORMATION DISPLAY DEVICE

[75] Inventor: Teodor Kalmykow, Scarborough, Canada

[73] Assignee: AS&G Lettering Systems Inc., Scarborough, Canada

[21] Appl. No.: 945,420

[22] Filed: Sep. 16, 1992

[51] Int. Cl.[5] ..... G09F 7/10

[52] U.S. Cl. ..... 40/611; 40/620; 40/585

[58] Field of Search ..... 40/585, 618, 620, 622, 40/657, 568, 611, 605; 403/381, 383, 375, 331, 397; 52/506, 508, 384, 385; 446/120, 121, 122, 127

[56] References Cited

U.S. PATENT DOCUMENTS

| | | | |
|---|---|---|---|
| 1,126,351 | 1/1915 | Beabes . | |
| 1,805,378 | 5/1931 | Send | 40/620 |
| 2,885,822 | 5/1959 | Onanian | 446/122 X |
| 4,219,952 | 9/1980 | Flath . | |
| 4,632,589 | 12/1986 | Hsiu . | |
| 5,189,822 | 3/1993 | Schmanski et al. | 40/611 |

FOREIGN PATENT DOCUMENTS

| | | | |
|---|---|---|---|
| 1118398 | 2/1982 | Canada . | |
| 1205288 | 6/1986 | Canada . | |
| 157908 | 2/1957 | Sweden | 40/620 |

*Primary Examiner*—Clifford D. Crowder
*Assistant Examiner*—Paul C. Lewis
*Attorney, Agent, or Firm*—Stanley E. Johnson

[57] ABSTRACT

An information display device wherein there is a base plate with information bearing face plates detachably mounted thereon by one or more spline elements that press-fit with formations on each of the opposing faces of the base and face plate. End caps are optional as are also separator strips between panels where there are a number of panels mounted on one base plate. Splines press-fit into grooves in each of the base plate and face plate. In one embodiment the spline is U-shaped receiving therein a rib on one member and projecting into a groove formed between two ribs on the other of the two plates.

22 Claims, 5 Drawing Sheets

INFORMATION DISPLAY DEVICE

FIELD OF INVENTION

This invention relates to an information display device and more particularly the construction of the same.

Information display devices of the present invention, commonly referred to as signs, are found on building walls and/or doors. The signs may contain multi information such as directories in the lobby of a building or reception area of a floor or limited information such as the activity and/or individual name conventionally found mounted on a wall or door. The signs of the present invention are also usable outdoors particularly where a number of information panels are grouped together as one sign board.

BACKGROUND OF INVENTION

Information display panels are well known and attention is directed to U.S. Pat. No. 4,219,952 issued Sep. 2, 1980 to W. Flath and Canadian Patent 1,205,288 issued Jun. 3, 1986 to C. E. Thompson. The present invention is an improvement over the construction of the sign illustrated in the latter patent '288. Disclosed in such patent is a sign consisting of two parallel mounting bars fixable to a wall and in which there are channels to receive respective ones of a pair of strips each of which has a number of projections. The projections are uniform in a repeating pattern with a center to center spacing corresponding to flanges that project rearwardly from an information bearing shallow channel sign plate. The information displaying sign plates can be snapped onto and off of the projections.

U.S. Pat. No. 4,219,952 discloses an information display device consisting of a base plate mounted on a backing plate and dove-tail grooves in the face of the base plate. The information display devices are in the form of blocks with a formation on the rear face that slidably fits into the dove-tail groove in the base plate.

SUMMARY OF INVENTION

An object of the present invention is to provide a simplified construction that is versatile so as to be usable either as a single name plate sign on a door or a multi-information display sign such as may be found in the lobby or outside of a building.

In keeping with the foregoing there is provided in accordance with the present invention an information display device comprising a base plate securable to a support surface; a face plate having an outer exposed surface on which information can be displayed; and at least one individual spline element of selected length interposed between said base plate and said face plate, the opposing faces of said plates having formations thereon which are in press-fit relation with said spline and thereby removably joining said plates together. End caps may be provided covering respective opposite ends of the assembled structure and wherein such end caps have one or more splines anchoring the end plate to each of the face plate and base plate.

LIST OF DRAWINGS

The invention is illustrated by way of example in the accompanying drawings wherein.

DESCRIPTION OF PREFERRED EMBODIMENT

Information display devices of the present invention comprise three basic components namely a base plate, one or more face plates and joining pieces that detachably interconnects the base and face plates in a press-fit (preferably snap press-fit) relation. End caps are also preferably provided to obscure from view the ends of the joined together base and face plates.

Figure 1:
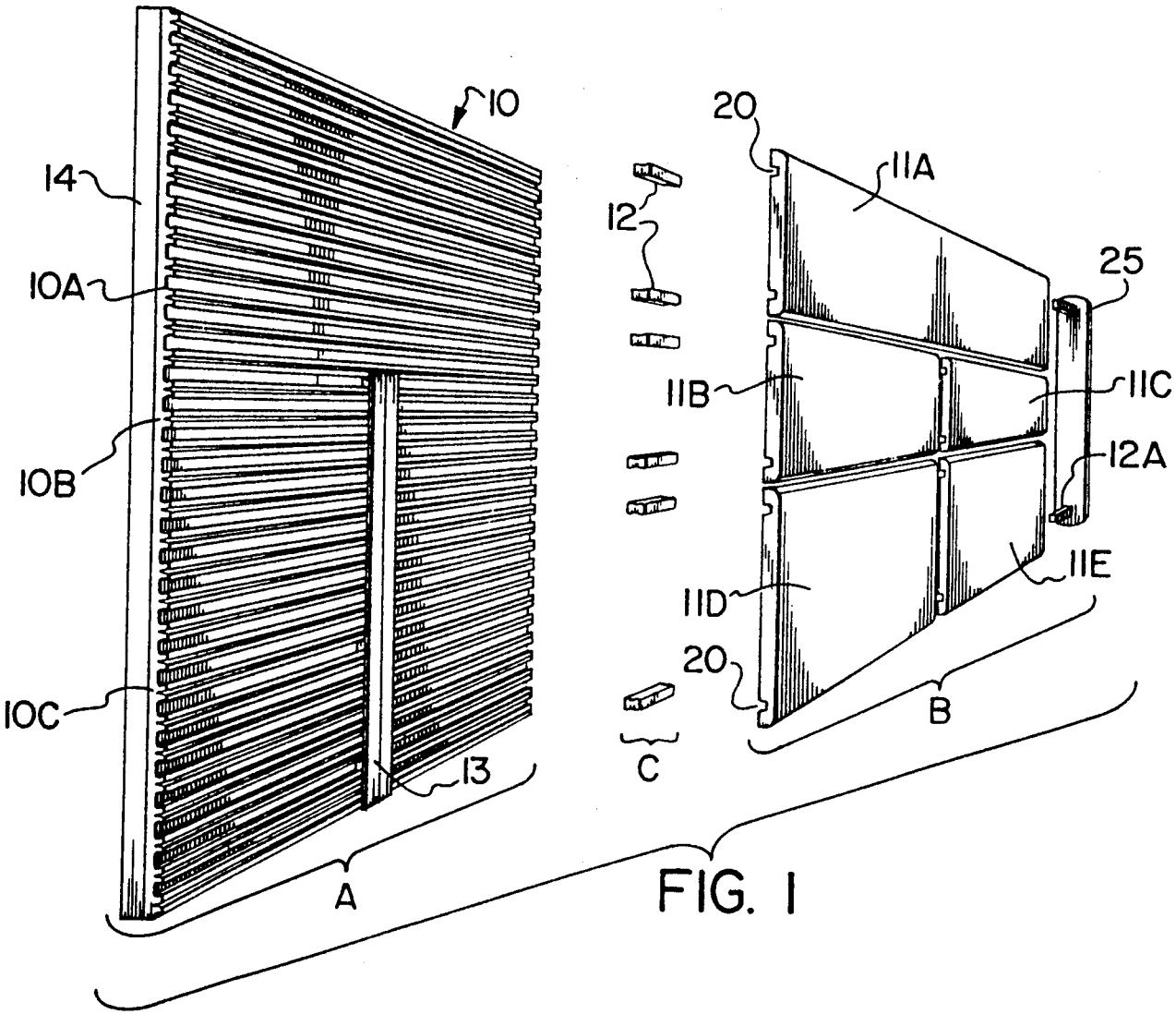
FIG. 1 is an exploded oblique view of an information display device provided in accordance with the present invention in which A illustrates a base plate with an optional divider thereon, B illustrates a plurality of face plates and C illustrates a plurality of splines.

Referring to FIG. 1 there is illustrated, in exploded view, a multi information display device comprising a base plate 10, face plates 11A, 11B, 11C, 11D and 11E and a plurality of joining pieces 12 that detachably connect the face plates to the base plate. Optionally a pair of end caps 25 (only one is shown for sake of clarity of illustration) obscure from view opposite ends of the assembled base and face plates. Optionally there may be one or more divider or filler strips 13.

While in FIG. 1B there is illustrated five face plates designated 11A, 11B, 11C, 11D and 11E, any number may be used and various arrangements obviously are possible. In the example illustrated face plates 11B and 11D, when mounted on the base plate 10 are separated from respective face plates 11C and 11E by the filler piece or spacer 13.

The front face of the base plate and the rear face of the face plates, i.e., the opposed faces of the plates each have formations thereon. These formations receive a portion of the spline elements 12 in a press-fit relation, (preferably snap press-fit relation) so as to detachably mount the face plates on the base plate.

Figure 4:
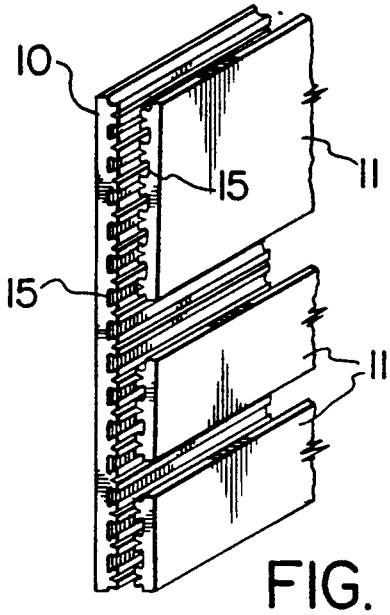
FIG. 4 is a partial oblique exploded view similar to FIG. 1 wherein the opposing faces of the face and base plates each have the same configuration of grooves thereon.

The base plate 10 may be a single member as illustrated in FIG. 4 or a plurality of members as for example those designated 10A, 10B and 10C in FIG. 1A. When there is more than one base plate 10 they can be mounted on a backing plate 14 as is also shown in FIG. 1A.

Figure 5:
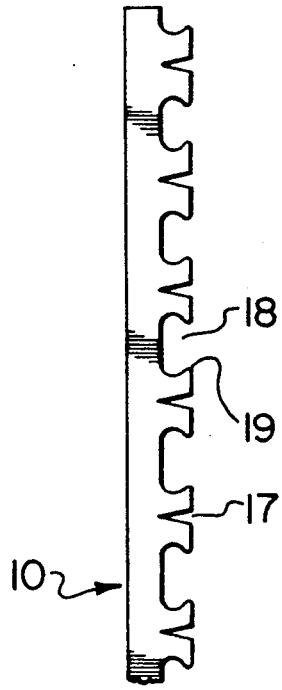
FIG. 5 is a partial end view of a portion of one of the plates of FIG. 4 on a larger scale.
Figure 7:
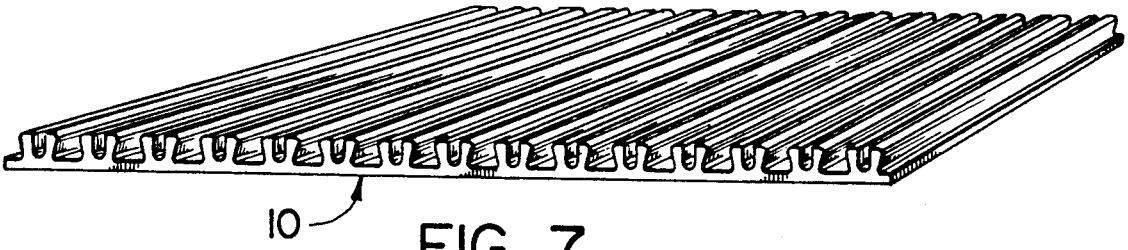
FIG. 7 is an oblique view of a plate (base or face) illustrating a variation from FIG. 5 of the ribs which define the parallel grooves.
Figure 8:
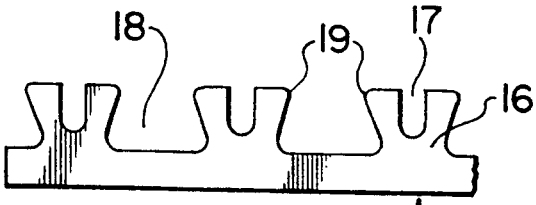
FIG. 8 is a partial end view of the plate element of FIG. 7 on a larger scale.
Figure 9:
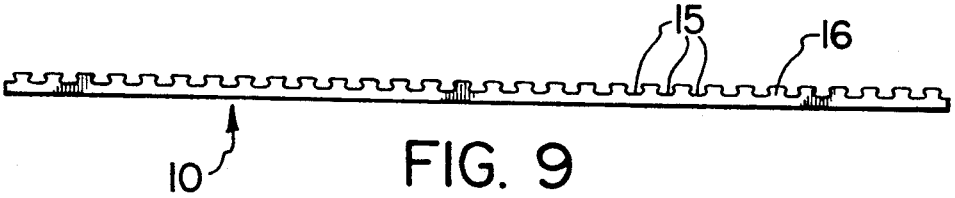
FIG. 9 is an end view similar to FIGS. 5 and 8 but on a smaller scale illustrating a modified rib arrangement which defines the groove on the plate.

The base plate formations preferably provide a plurality of parallel equi-spaced grooves 15 separated one from the next with each formation being in the form of a rib 16 that extends from one end to the other of the member. The ribs are preferably parallel to a pair of edges of the base plate and the arrangement of ribs extends from one such edge to the other. In other words the entire face surface of the base plate has the parallel groove formation thereon. Preferably there is a half groove width at each of said two edges. Each rib 16 may be solid in cross-section and as seen in FIG. 9 or alternatively multi-finger as illustrated in FIGS. 5, 7 and 8 resulting from one or more V-shaped or U-shaped grooves 17. Each groove 15 is somewhat dove-tail in cross-sectional shape having a throat 18 that is narrower than the base of the groove. The ribs 16 have rounded edges 19 defining the throat, i.e., entry into the groove.

Figure 2:
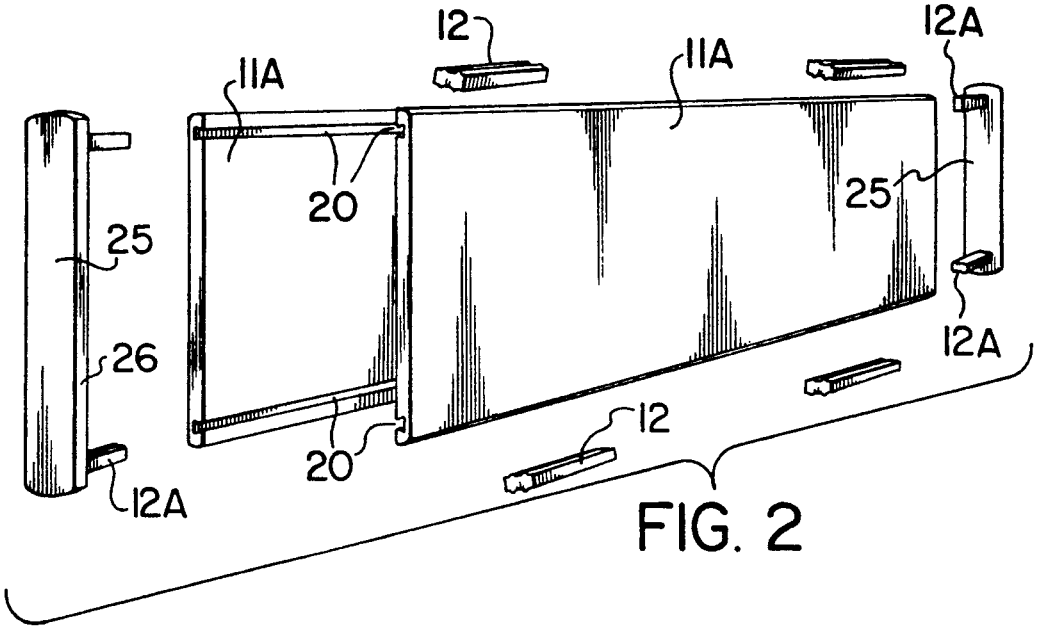
FIG. 2 is an oblique exploded view of an individual door or wall information display device in which the base plate is the same as the face plate, both being the same as a face plate of FIG. 1B.
Figure 3:
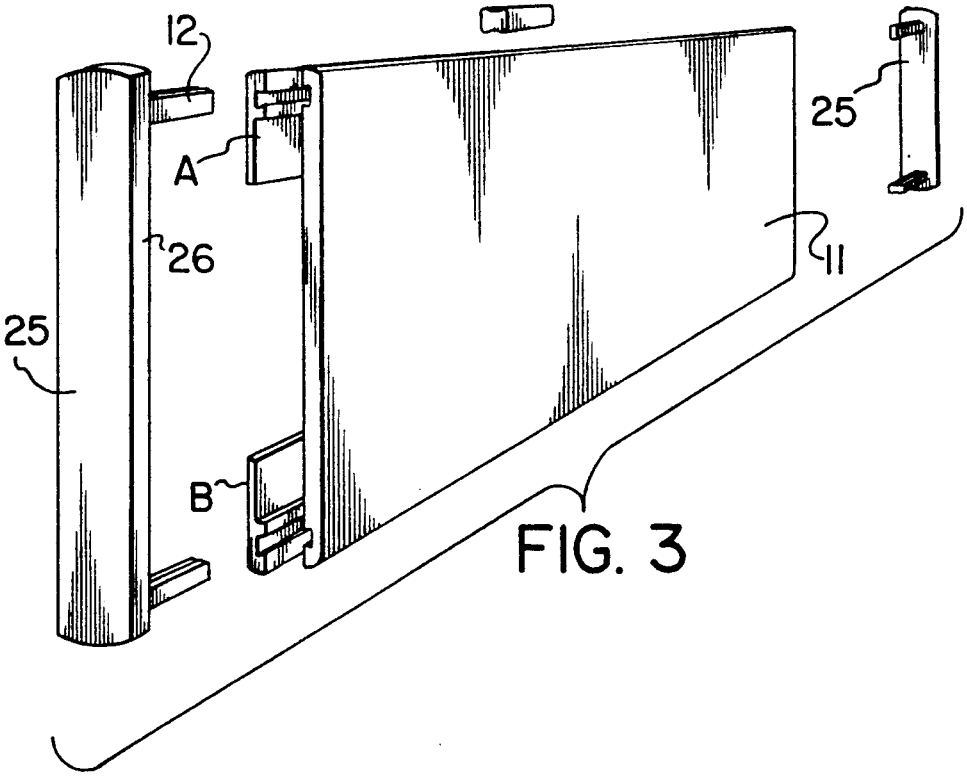
FIG. 3 is an oblique exploded view of an information display device similar to FIG. 2 but having a modified base.

The face plates of FIGS. 1 to 3 have one or more grooves 20 in the rear face which, in cross-section, are of similar configuration to the grooves 15 (see for example FIG. 5). An arrangement is illustrated in FIG. 4 wherein each face plate has a multiplicity of parallel grooves 15 on its rear face corresponding to the grooves on the front face of the base plate 10. Effectively in FIG. 4 the base and face plates are of identical construction except that the face plates are narrower so that a number of face plates can be mounted on a single base plate. The base plate however may be as illustrated in FIG. 1 made up from a number of base plate elements mounted on a backing plate. The plate elements are elongate extruded strips of aluminum, plastics or other suitable material.

The face plates illustrated in FIG. 1 each have two parallel grooves 20 in their respective rear faces. The grooves are located adjacent the upper and lower marginal edges of the respective plates. A single groove could be used and only a single spline to join a face plate to a base plate but in most instances there would be a minimum of two grooves and a minimum of four splines per face plate.

Figure 11:
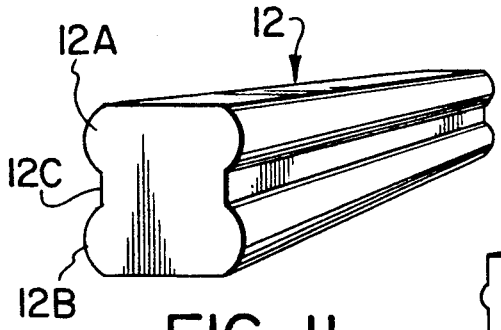
FIG. 11 is an oblique view of a spline used to join the base and face plates.
Figure 12:
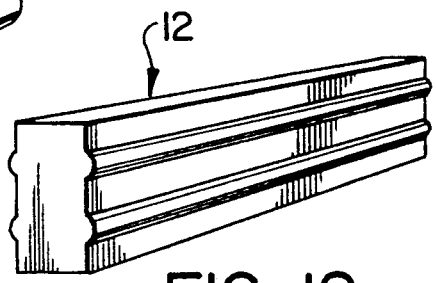
FIG. 12 is an oblique view similar to FIG. 11 illustrating a modified spline.
Figure 13:
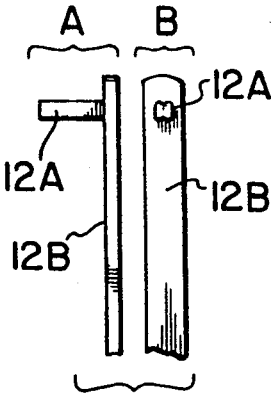
FIGS. 13A and 13B are respectively a partial side and front elevational view of an end cap.
Figure 14:
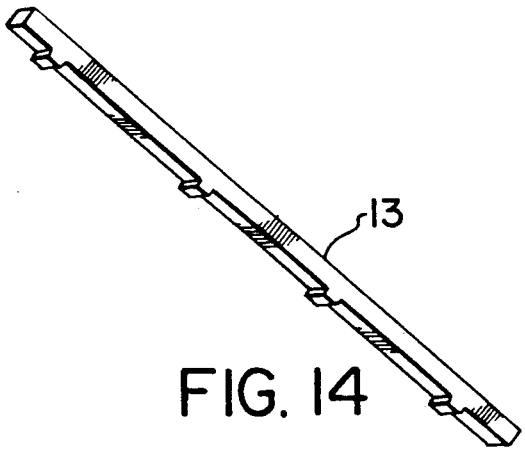
FIG. 14 is an oblique view of the divider or spacer strip shown mounted on the base plate in FIG. 1.

A single spline is illustrated in FIG. 11 and consists of a selected length of material with a bulbous upper portion 12A and a lower bulbous portion 12B that are separated one from the other by a narrow central narrower neck portion 12C. The bulbous portions are designed for a snug fit in an opposed pair of grooves one being in the base plate and the other in the face plate. Rounded corners of the spline and/or throat edge 19 permit pressing the spline into the groove. The dimensions of the throat 18 of the groove and the size of the spline are such as is also the resiliency of the material that not only is there a press-fit but also a snap-fit relation upon pressing the face plate onto the spline and the spline into the groove of the base plate. The spline may be a plastics material or a rubber material with selected resiliently elastic characteristics for a snap snug fit into the grooves. A variation in the cross-sectional configuration of the spline is illustrated in FIG. 12.

FIGS. 1, 2 and 3 illustrate end caps to obscure from view the ends of the assembled together base and face plates. Each end cap 25 has securely fastened thereto one or more splines 12A. These splines 12A can be of a rigid material so as to slide from the end into aligned grooves in the base and face plate thereby locking the face plate to the base plate. Alternatively the splines 12A can be made of a semi-resilient material or a resiliently elastic material permitting a press-fit sideways into the groove where desired. There may in some instances be space limitations preventing sliding the spline into the grooves from the end thus necessitating the sideways press-fit. Each end cap 25 is a flat piece of material 26 of sufficient width to cover the end of the base plate and face plate and also if desired the backing plate in the case where there is a backing plate for the base plate.

In the embodiment illustrated in FIG. 2 the base plate and face plate are identical and in fact are two face plates 11A of FIG. 1. The face plate which serves as a base plate can be secured by screws and/or adhesively to a wall or door. The two plates are joined together by four splines 12 and opposite ends are covered by a respective one of the pair of end caps 25. FIG. 3 illustrates an alternative wherein the base plate comprises two parallel elements A each with a single groove for receiving one or more splines in a press snap-fit relation. The embodiments of FIGS. 2 and 3 are typical door or wall signs.

Figure 6:
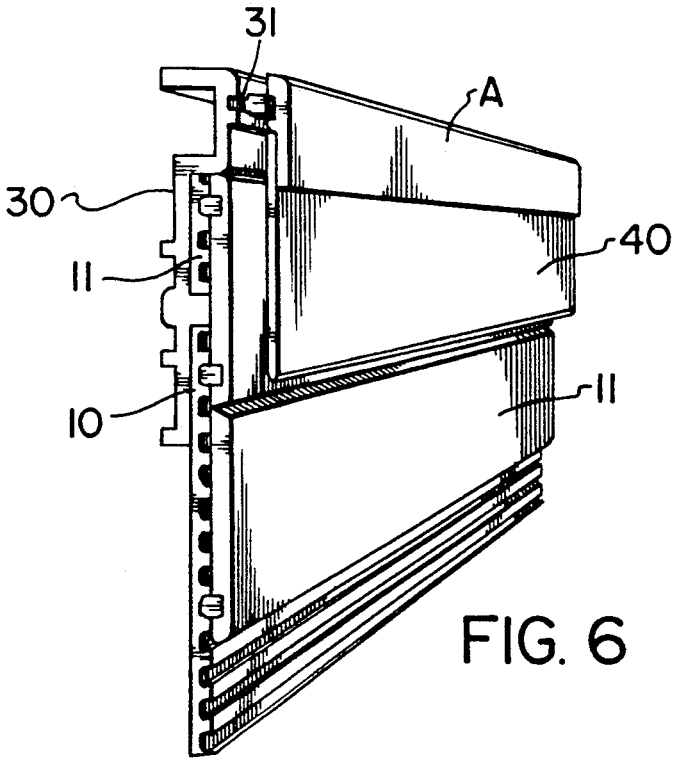
FIG. 6 is an oblique partial view illustrating a still further arrangement of an information display device that has a peripheral frame of which only the upper portion is illustrated.

In the arrangement illustrated in FIG. 6 there is a peripheral frame 30 only part of which is illustrated and which supports a number of base plates 10. Face plates 11 are mounted on the base plates by splines as previously described and a panel 40 serves as a cover to protect information messages on the face plates from vandalism in lobby and elevator directories.

The frame 30 has a groove 31 for receiving a spline 12 to snap-fit thereonto a cover plate which corresponds to element A of FIG. 3. The cover plates (element A and only one of which is illustrated) overlap the outer periphery of the cover 40 clamping it to the peripheral frame 30.

Figure 6A:
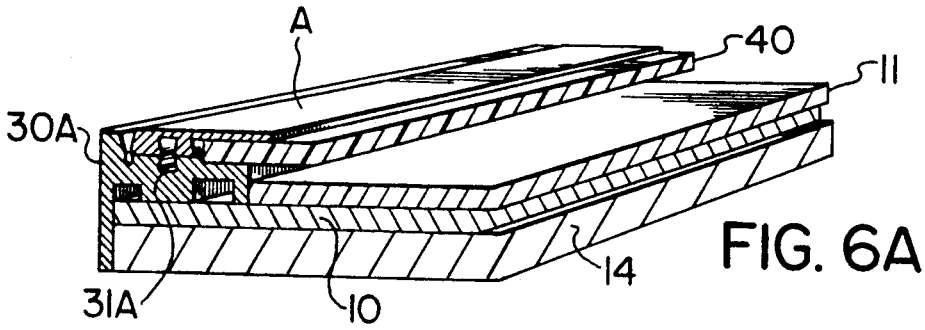
FIG. 6A is similar to FIG. 6 but illustrating a modified frame.

FIG. 6A in partial perspective illustrates a modified frame structure in a sign construction of the type illustrated in FIG. 6. The sign of FIG. 6A has a transparent cover 40 that overlies the information display face of the sign. The information display face comprises one or more face plates 11 and these are mounted on a base plate 10 which in turn is mounted on a back plate 14 all of which has been previously described in detail in other embodiments. In the present embodiment a peripheral frame member 30A extends around the outer periphery of the assembly 10, 11, 14. The transparent cover plate 40 rests on a flange portion of the peripheral frame member 30A and is thus held spaced from the face plates 11. Members A attach in a press-fit relation to members 30A by splines 12 that project into aligned grooves in the respective members. Members A press the transparent sheet against the above mentioned flange portion of member 30A thus retaining the transparent sheet or cover in position.

In all of the embodiments illustrated each face plate has an outer face and information as may be desired would be displayed on such face as, for example, an activity or name or both.

Figure 10:
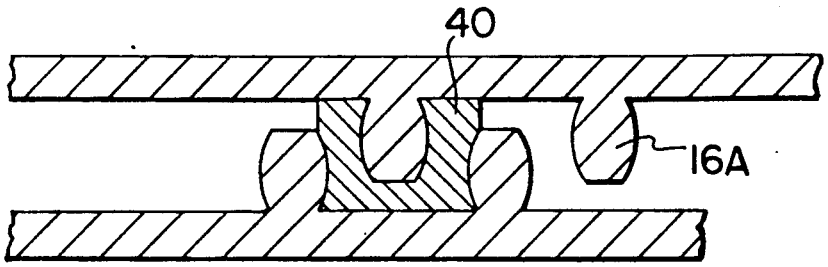
FIG. 10 is a partial sectional view illustrating a modified arrangement of projections on the base and face plates and a U-shaped spline detachably joining the two plate members together.

An alternative arrangement of joining the face and backing plates is illustrated in FIG. 10 wherein ribs 16A are spaced further from one another than the previously described ribs 16. The ribs 16A are appropriately spaced so that on one plate a U-shaped joining strip 40 press-fits between two adjacent ribs and a single rib on the other plate projects into the bite of such U-shaped strip. The ribs 16A are parallel to one another on each of the respective plates and have an outwardly bulging central portion providing a snap press-fit in joining the two plates together.

In the embodiment of FIG. 10 the face plate and base plate are identical as is also the case with the embodiments illustrated in FIGS. 2 and 4. In the embodiments of FIGS. 2 and 4 the splines press-fit into opposed grooves while in FIG. 10 a spline press-fits into a groove on one plate and onto an opposed rib on the other plate.

In all of the foregoing embodiments the base and face plates may be metal or a plastics material. The base plate for example may be aluminum and the face plate plastic or vice versa. Alternatively both the base and the face plates may be a plastics material or both made of aluminum. The plates are preferably extrusions and with one face having ribs providing cross-sectional configurations illustrated in the various figures. The grooves alternatively could be machine formed but at a substantially greater cost.

In a typical device the grooves 15 may have for example a center-to-center distance of 5 millimeters, a throat width of 2 millimeters and a groove base width of 3 millimeters. The plate may have a thickness of 3 or 4 millimeters. The groove 17 in FIG. 5 may have a depth of about 1.5 millimeters and an included angle of 15°. The spline of FIG. 11 may have a length of 40 millimeters, an overall width of 2.7 millimeters and a depth of 3 millimeters. In this depth of 3 millimeters the upper and lower bulbous portions may each be about 1.25 millimeters and the central narrow neck portion about 0.5 millimeters. The reduced central section or neck down part has a width of approximately 2 millimeters. The spline of FIG. 12 has an overall width of 2.16 millimeters, a depth of 3.8 millimeters and a minimum width of 1.8 millimeters. The two parallel ribs on one face are spaced 1 millimeter from one another. The throat width of the groove 15, i.e., distance between two adjacent edges 19 of the ribs is also 2 millimeters. These measurements are given by way of example only.

In the foregoing the term press-fit is used not only to indicate that some force is needed to insert a spline into a groove but also that such force is applied in the general direction of from the throat toward the base of the groove. Effectively the spline moves sideways into the groove rather than longitudinally into the groove with respect to the length of the groove.

We claim:

1. An information display device comprising:

(a) a base plate securable to a support surface;

(b) a face plate having an outer exposed surface on which information can be displayed, said base plate and face plate having opposing faces disposed in face-to-face relation and wherein each of said opposing faces have spaced apart parallel grooves; and (c) spline elements of selected cross-sectional configuration and of selected length interposed between said base plate and said face plate, said spline elements projecting into the grooves on the respective plates and in press-fit relation therewith removably joining said plates together, each of said grooves, in cross-section, have a throat entry into the groove which is narrower than the groove and wherein each said spline, in cross-section, has spaced apart enlargements, said spaced apart enlargements being forceable through the throat of opposed grooves respectively in said face plate and said base plate and thereby providing said press-fit relation.

2. An information display device as defined in claim 1 wherein said grooves in said base plate are provided by a plurality of a parallel ribs.

3. An information display device as defined in claim 2 wherein said ribs are disposed in parallel selected spaced apart relation defining a groove between each adjacent pair of ribs.

4. An information display device as defined in claim 3 wherein said ribs are equi-spaced.

5. An information display device as defined in claim 4 wherein said grooves are generally dove-tail in cross-sectional shape.

6. An information display device as defined in claim 3 wherein said ribs extend from one side edge of the plate to an opposite side edge thereof.

7. An information display device as defined in claim 1 wherein each said spline is a plastics material of selected resiliency.

8. An information display device as defined in claim 1 wherein each said spline is of a rubber material of selected resiliency.

9. An information display device as defined in claim 1 including a backing plate and means securely fastening said base plate to said backing plate.

10. An information display device as defined in claim 1 wherein each said spline in cross-section has spaced apart parallel bulbous portions and wherein said respective bulbous portions snap-fit through a throat into a groove in a respective one of said base plate and face plate.

11. An information display device comprising:

(a) a base plate member having a front face with formations thereon comprising a plurality of equi-spaced parallel ribs, each pair of adjacent ribs defining a groove therebetween having in cross-section a base that is wider than the entry into the groove; said ribs covering the entire face of the base plate and parallel to a selected pair of opposite marginal edges, the first rib adjacent each said opposite marginal edges being spaced from the edge associated therewith by an amount equal to one half of the width of a groove;

(b) a face plate having a front face for the display of information thereon and a rear face, said rear face having at least two parallel grooves therein spaced from one another a distance equal to a whole number multiple of the spacing of two adjacent grooves in said base plate, said face plate grooves each having, in cross-section, a shape corresponding to that of a groove in said base plate; and (c) a plurality of discrete length splines having, in cross-section, a respective upper and lower bulbous portion of suitable dimensions and elastic resiliency to snap press-fit into opposed aligned grooves in said base and face plate, said splines detachably interconnecting said base plate and said face plate.

12. The device of claim 11 including two or more of said base plates mounted on a backing plate.

13. The device of claim 12 wherein said base plates lie in a common plane.

14. The device of claim 13 wherein said base plate is an extruded aluminum member.

15. The device of claim 11 wherein each of said face and base plates is an extruded member and wherein they have identically arranged ribs thereon.

16. An information display device as defined in claim 11 including a frame extending around the periphery thereof, a transparent cover overlying the displayed information and means retaining said transparent cover in position on said peripheral frame.

17. An information display device comprising:

(a) a base plate securable to a support surface;

(b) a face plate having an outer exposed surface on which information can be displayed, said base plate and face plate having opposing faces and wherein each of said opposing faces have formations thereon; and (c) at least one individual spline element of selected length interposed between said base plate and said face plate and in press-fit relation with said formations on the respective plates thereby removably joining said plates together and including a backing plate and means securely fastening said base plate to said backing plate and including a frame extending around the periphery thereof, a transparent cover overlying the displayed information and means retaining said transparent cover in position on said peripheral frame and wherein said retaining means comprises extruded elements snap-fit onto said peripheral frame.

18. An information display device as defined in claim 17 wherein said snap-fit of the retaining and peripheral frame means is provided by splines fitting into grooves disposed in face to face relation in said retainer and peripheral frame.

19. An information display device comprising:

(a) a base plate member securable to a support structure and having a front face with formations thereon comprising a plurality of parallel ribs defining a plurality of parallel grooves, each groove having, in cross-section, a throat entry thereto that is narrower than the groove associated therewith;

(b) a face plate having a front face for the display of information thereon and a rear face, said rear face having at least two parallel grooves spaced apart in co-relation with the spacing of the grooves in said base plate for face to face alignment with selected ones thereof, said face plate grooves, in cross-section, each having a throat entry thereto that is narrower than the groove associated therewith; and (c) a plurality of discrete length splines having, in cross-section, respective spaced apart enlarged portions of suitable dimensions and elastic resiliency to snap press-fit into opposed aligned grooves in said base and face plate, said splines detachably interconnecting said base plate and said face plate.

20. An information display device as defined in claim 19 wherein each said spline is of a material selected from rubber and plastics and wherein each said spline, in cross-section, has spaced apart first and second parallel bulbous portions, said bulbous portions being forceable through the throat of the grooves in a respective one of said base plate and face plate and thereby providing said snap press-fit relation.

21. An information display device as defined in claim 19 wherein each of said face and base plates have a thickness of approximately 3 to 4 mm and wherein the grooves therein have a depth of approximately 1.5 mm.

22. An information display device as defined in claim 11 wherein each of said face and base plates have a thickness of approximately 3 to 4 mm and wherein the grooves therein have a depth of approximately 1.5 mm.

* * * * *